US011813866B2

(12) United States Patent
Yamamoto et al.

(10) Patent No.: US 11,813,866 B2
(45) Date of Patent: Nov. 14, 2023

(54) LIQUID DISCHARGING HEAD

(71) Applicant: Brother Kogyo Kabushiki Kaisha, Nagoya (JP)

(72) Inventors: Jiro Yamamoto, Nagoya (JP); Yasuhiro Sekiguchi, Nagoya (JP); Yoshitsugu Morita, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 38 days.

(21) Appl. No.: 17/557,616

(22) Filed: Dec. 21, 2021

(65) Prior Publication Data

US 2022/0250382 A1 Aug. 11, 2022

(30) Foreign Application Priority Data

Feb. 9, 2021 (JP) ..... 2021-019165

(51) Int. Cl.
*B41J 2/14* (2006.01)

(52) U.S. Cl.
CPC .. *B41J 2/14201* (2013.01); *B41J 2002/14419* (2013.01)

(58) Field of Classification Search
CPC ..... B41J 2/14201; B41J 2002/14419; B41J 2002/14306
See application file for complete search history.

(56) References Cited

U.S. PATENT DOCUMENTS

| | | | |
|---|---|---|---|
| 7,431,444 | B2 | 10/2008 | Ito |
| 8,690,284 | B2 | 4/2014 | Takata et al. |
| 2005/0225608 | A1 | 10/2005 | Ito |
| 2012/0249642 | A1 | 10/2012 | Takata et al. |
| 2019/0084303 | A1* | 3/2019 | Sugiura ..... B41J 2/14233 |

FOREIGN PATENT DOCUMENTS

| | | |
|---|---|---|
| JP | 2005-231314 A | 9/2005 |
| JP | 2012-206333 A | 10/2012 |

OTHER PUBLICATIONS

JP 2014061674 A , Ito Atsushi, "Liquid Jet Head", Apr. 10, 2014, Background Art (Year: 2014).*
IP.com search (Year: 2023).*

* cited by examiner

*Primary Examiner* — Lisa Solomon
(74) *Attorney, Agent, or Firm* — Banner & Witcoff, Ltd.

(57) ABSTRACT

A liquid discharging head includes: a supply hole to which liquid is supplied from outside thereof; a plurality of supply manifolds arranged below the supply hole, extending in an extending direction respectively, and configured to communicate with the supply hole; and at least one partition wall configured to partition the supply manifolds from each other. Each of the supply manifolds has a manifold hole below the supply hole, the supply manifolds communicate with each other in a common space below the at least one partition wall, and the manifold hole of one supply manifold is arranged so that another manifold hole of another supply manifold is not located on an extension line, of the manifold hole, along the extending direction.

11 Claims, 9 Drawing Sheets

LIQUID DISCHARGING HEAD

CROSS REFERENCE TO RELATED APPLICATIONS

The present application claims priority from Japanese Patent Application No. 2021-019165, filed on Feb. 9, 2021, the disclosure of which is incorporated herein by reference in its entirety.

BACKGROUND

The present disclosure relates to a liquid discharging head configured to discharge liquid such as ink, etc.

DESCRIPTION OF THE RELATED ART

There is a conventionally known discharging head having a configuration wherein four supply manifolds are communicated with one supply hole. Further, a crosspiece defining each of the four supply manifolds is provided at a location below the supply hole.

SUMMARY

In this conventional configuration, two supply manifolds which are at the outer side among the four supply manifolds communicating with the supply hole have a shape which draws an arc rather than extending in one direction. Accordingly, there is such a possibility that a flow of liquid is greatly curved or bent inside the two supply manifolds which are located on the outer side. Therefore, in a case that a common space communicating the supply manifolds with one another is provided at a location below the crosspiece, any stagnation of the liquid is generated in this common space. Further, there is such a fear that any air might remain in the stagnation, that a change in the pressure might be absorbed by the air, and that the liquid might not be allowed to flow in a desired flow amount. Further, in a case that the air flows to the downstream side of the supply manifold(s), there is such a fear that a nozzle might be clogged by the air and any non-discharge (omission of discharge) might occur.

An object of the present disclosure is to provide a liquid discharging head configured to allow the liquid to easily flow in a desired amount and capable of suppressing or preventing any occurrence of non-discharge.

According to an aspect of the present disclosure, there is provided a liquid discharging head including:

- a supply hole to which liquid is supplied from outside thereof;
- a plurality of supply manifolds arranged below the supply hole, extending in an extending direction respectively, and configured to communicate with the supply hole; and
- at least one partition wall configured to partition the supply manifolds from each other,
- wherein each of the supply manifolds has a manifold hole below the supply hole,
- the supply manifolds communicate with each other in a common space below the at least one partition wall, and
- the manifold hole of one supply manifold is arranged so that another manifold hole of another supply manifold is not located on an extension line, of the manifold hole, along the extending direction.

According to the present disclosure, the manifold hole of the one supply manifold is arranged so that the another manifold hole of the another supply manifold is not located on the extension line, of the manifold hole, along the extending direction. Accordingly, any stagnation of the liquid supplied from the supply hole hardly occurs. With this, it is possible to prevent such a situation that any air remains due to the stagnation and the change in the pressure is absorbed by the air and that the liquid is thereby prevented from flowing in a desired flow amount toward the downstream side of each of the supply manifolds. Further, it is also possible to prevent such a situation that the air flows to the downstream side of the supply manifold(s), and thus a nozzle is clogged by the air, and to prevent any non-discharge (omission of discharge) from occurring.

DETAILED DESCRIPTION

In the following, a liquid discharging head according to an embodiment of the present disclosure will be explained, with reference to the drawings. The liquid discharging head to be explained in the following is merely an embodiment of the present disclosure. Accordingly, the present disclosure is not limited to or restricted by the following embodiment; any addition, deletion and/or change are/is possible within the range not departing from the gist and spirit of the present disclosure.

First Embodiment

Figure 1:
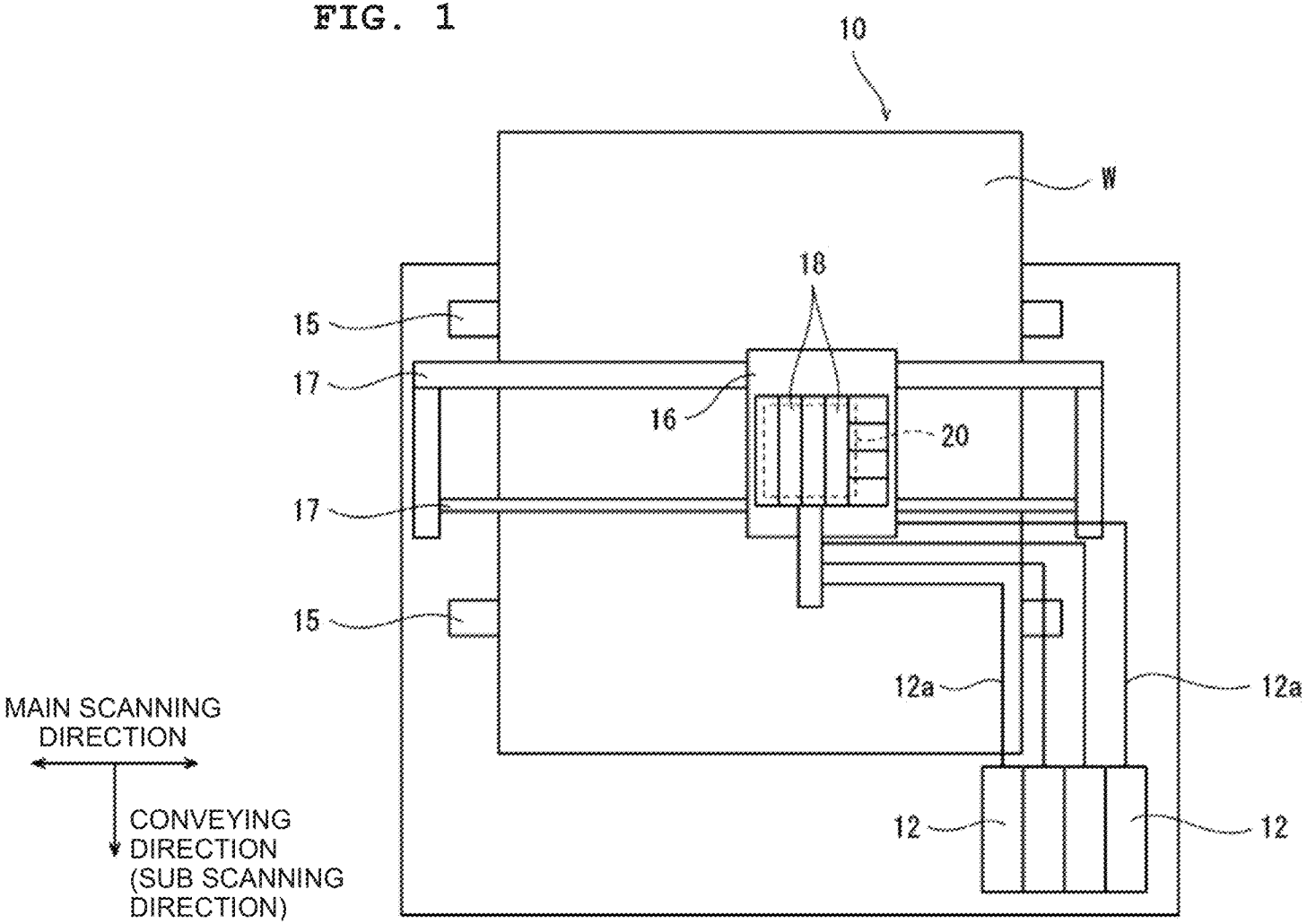
FIG. 1 is a plane view schematically depicting the configuration of a liquid discharging apparatus according to an embodiment of the present disclosure.

As depicted in FIG. 1, a liquid discharging head 20 of the present embodiment is provided on a liquid discharging apparatus 10. The liquid discharging apparatus 10 includes, in addition to the liquid discharging head 20 configured to discharge liquid, a storing tank 12, a carriage 16, a pair of conveying rollers 15, a pair of guide rails 17 and a sub tank 18. Note that a discharge target medium W which is, for example, print paper (print paper sheet) is arranged on a platen (not depicted in the drawings) in the liquid discharging apparatus 10.

The liquid discharging head 20 and the sub tank 18 are mounted on the carriage 16. The carriage 16 is supported by the pair of guide rails 17 which extend in a main scanning direction orthogonal to a conveying direction of the discharge target medium W (sub scanning direction), and moves reciprocally in the main scanning direction along the pair of guide rails 17. With this, the liquid discharging head 20 moves reciprocally in the main scanning direction. The liquid discharging head 20 is connected to the storing tank 12 via a tube 12*a*.

The pair of conveying rollers 15 are arranged to parallel to each other along the main scanning direction. In a case that a conveying motor (not depicted in the drawings) is driven, the pair of conveying rollers 15 rotates, thereby conveying the discharge target medium W on the platen in the conveying direction.

An ink, as an example of the liquid, is stored in the storing tank 12. The storing tank 12 is connected to the liquid discharging head 20 via the tube 12*a* so as to supply the liquid to the liquid discharging head 20. Further, in a case that the liquid is the ink, the storing tank 12 is provided per a kind of the ink. The storing tank 12 is provided, for example, as four storing tanks 12, and black, yellow, cyan and magenta inks each as the liquid are stored in the four storing tanks 12, respectively. Note that the following explanation will be made regarding a case wherein the inks are used as the liquid.

Figure 2:
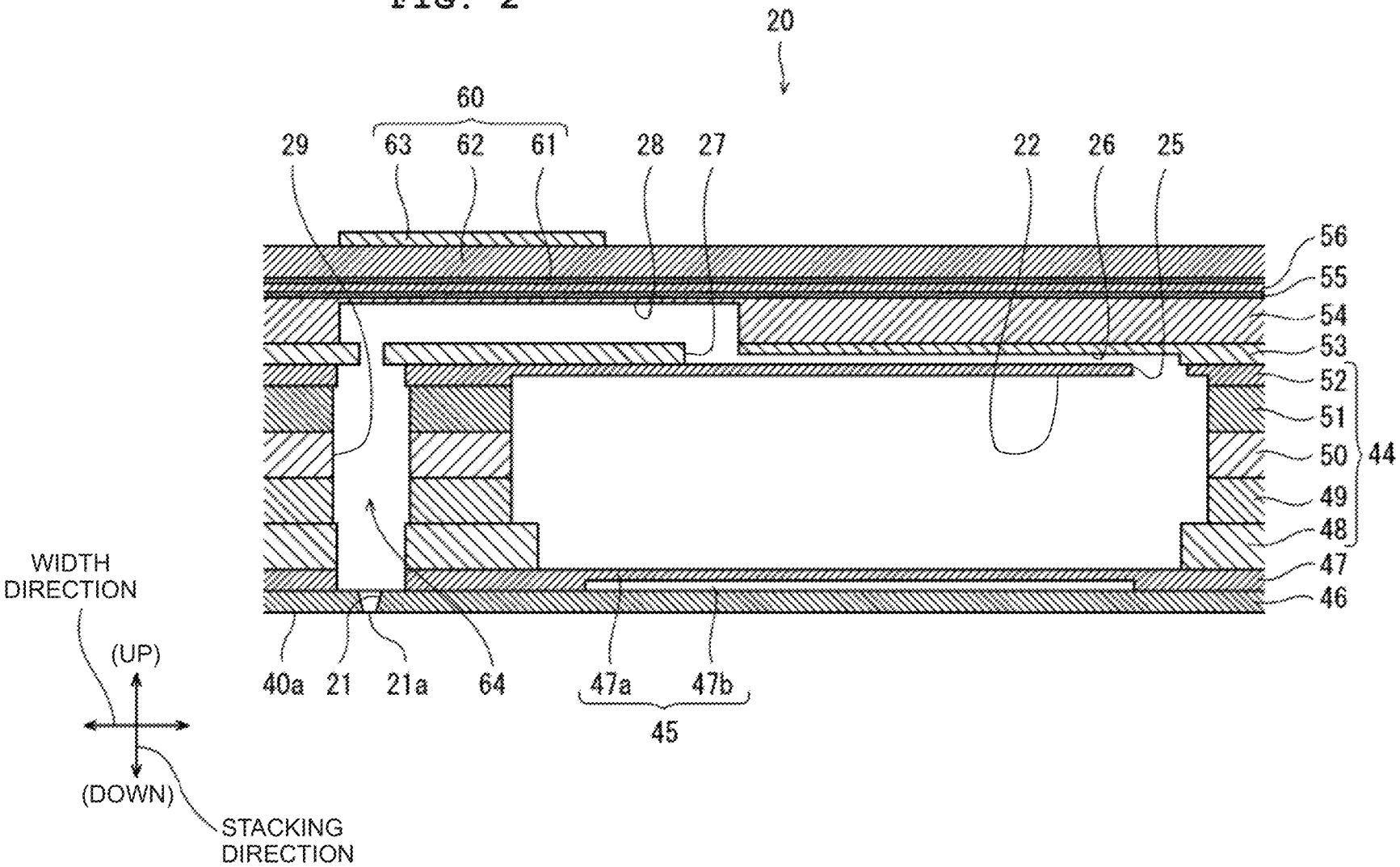
FIG. 2 is a cross-sectional view of a liquid discharging head of FIG. 1.

Next, the cross-sectional configuration of the liquid discharging head 20 will be explained. As depicted in FIG. 2, the liquid discharging head 20 has a plurality of nozzles 21 configured to discharge a droplet of the liquid (liquid droplet) by using the inks from the storing tanks 12. The liquid discharging head 20 is a stacked body of a channel forming body and a volume changing part. In the inside of the channel forming body, an ink channel is formed, and a plurality of nozzle holes 21*a* are opened in a discharge surface 40*a* which is a lower surface of the channel forming body. Further, the above-described volume changing part is driven so as to change the volume of the ink channel. In this case, meniscus is vibrated in the nozzle holes 21*a*, thereby discharging the ink.

The channel forming body of the liquid discharging head 20 is a stacked body of a plurality of plates, and the volume changing part includes a vibration plate 55 and an actuator (piezoelectric element) 60. An insulating film 56 is formed on the vibration plate 55, and a common electrode 61 (which will be described later on) is formed on the insulating film 56.

The plurality of plates includes a nozzle plate 46, a spacer plate 47, a first channel plate 48, a second channel plate 49, a third channel plate 50, a fourth channel plate 51, a fifth channel plate 52, a sixth channel plate 53 and a seventh channel plate 54, and these plates are stacked, in this order, from a lower side.

Each of the plurality of plates is formed with holes and grooves of various sizes. In the channel forming body in which the respective plates are stacked, the holes and the grooves are combined to thereby form, as the ink channel, the plurality of nozzles 21, a plurality of individual channels 64, and a supply manifold 22.

The plurality of nozzles 21 are formed to penetrate through the nozzle plate 46 in a stacking direction. In the discharge surface 40*a* of the nozzle plate 46, the plurality of nozzles holes 21*a* which are forward ends, respectively, of the plurality of nozzles 21 are aligned in an aligning direction to form a nozzle row. Note that the aligning direction is a direction orthogonal to the stacking direction.

The supply manifold 22 supplies the ink to a pressure chamber 28 (to be described later on) to which a discharge pressure of the ink is applied. The supply manifold 22 extends in the aligning direction and is connected to an end of each of the plurality of individual channels 64. Namely, the supply manifold 22 functions as a common channel of the ink. The supply manifold 22 is formed by stacking, in the stacking direction, through holes each of which penetrates through one of the first to fourth channel plates 48 to 51 in the stacking direction and a recess which is recessed from a lower surface of the fifth channel plate 52.

The nozzle plate 46 is arranged at a location below the spacer plate 47. The spacer plate 47 is formed, for example, of stainless steel. The spacer plate 47 is recessed, for example, by half etching from a surface, of the spacer plate 47, on the side of the nozzle plate 46 in a thickness direction of the spacer plate 47 so that the spacer plate 47 has a recessed part 45 in which a thinned part forming a damper part 47*a* and a damper space 47*b* are formed. By such a configuration, the damper space 47*b* as a buffer space is formed between the supply manifold 22 and the nozzle plate 46.

Each of the plurality of individual channels 64 is connected to the supply manifold 22. An upstream end of each of the plurality of individual channels 64 is connected to the supply manifold 22, and a downstream end of each of the plurality of individual channels 64 is connected to a base end of one of the plurality of nozzles 21. Each of the plurality of individual channels 64 has a first communicating hole 25, a supply throttle channel 26 which is an individual throttle channel, a second communicating hole 27, a pressure chamber 28 and a descender 29; and these constituent elements are arranged in this order.

A lower end of the first communicating hole 25 is connected to an upper end of the supply manifold 22. The first communicating hole 25 extends from the supply manifold 22 upward in the stacking direction, and penetrates through an upper part in the fifth channel plate 52.

An upstream end of the supply throttle channel 26 is connected to an upper end of the first communicating hole 25. The supply throttle channel 26 is formed, for example, by the half etching, and is constructed of a recess which is recessed from the lower surface of the sixth channel plate 53. Further, an upstream end of the second communicating hole 27 is connected to a downstream end of the supply throttle channel 26. The second communicating hole 27 extends from the supply throttle channel 26 upward in the stacking direction, and is formed to penetrate through the sixth channel plate 53 in the stacking direction.

An upstream end of the pressure chamber 28 is connected to a downstream end of the second communicating hole 27. The pressure chamber 28 is formed to penetrate through the seventh channel plate 54 in the stacking direction.

The descender 29 is formed to penetrate through the spacer plate 47, the first channel plate 48, the second channel plate 49, the third channel plate 50, the fourth channel plate 51, the fifth channel plate 52 and the sixth channel plate 53 in the stacking direction. An upstream end of descender 29 is connected to a downstream end of the pressure chamber 28. A downstream end of the descender 29 is connected to the base end of each of the plurality of nozzles 21. Each of the plurality of nozzles 21 overlaps, for example, in the stacking direction with the descender 29, and is arranged at the center in the width direction of the descender 29.

The vibration plate 55 is stacked on the seventh channel plate 54, and covers an opening of an upper end of the pressure chamber 28.

The actuator 60 includes a common electrode 61, a piezoelectric layer 62 and an individual electrode 63 which are stacked in this order. The common electrode 61 covers, via the insulating film 56, an entire surface of the vibration plate 55. The piezoelectric layer 62 covers, via the insulating film 56 and the common electrode 61, the entire surface of the vibration plate 55. The individual electrode 63 is provided on each piece of the pressure chamber 28, and arranged on the piezoelectric layer 62. One piece of the actuator 60 is constructed of one piece of the individual electrode 63, the common electrode 61 and a part (active part), of the piezoelectric layer 62, which is sandwiched by one piece of the individual electrode 63 and the common electrode 61.

The individual electrode 63 is electrically connected to the driver IC. The driver IC receives a control signal from a controller (not depicted in the drawings), generates a driving signal (voltage signal) and applies the generated driving signal to the individual electrode 63. With respect to this, the common electrode 61 is always maintained at the ground potential. In such a configuration, the active part of the piezoelectric layer 62 expands and contracts in a plane direction together with two electrodes 61 and 63, depending on the driving signal. Accompanying with this, the vibration plate 55 cooperates with this and deforms in a direction increasing or decreasing the volume of the pressure chamber 28. With this, a discharge pressure for causing the ink to be discharged from the nozzle 21 is applied to the pressure chamber 28.

In a case that a pump is driven in the liquid discharging head 20 as described above, the ink flows from the sub tank 18 into the supply manifold 22 via the supply hole 24. Then, the ink flows from the supply manifold 22 into the supply throttle channel 26 via the first communicating hole 25, and flows from the supply throttle channel 26 into the pressure chamber 28 via the second communicating hole 27. Then, the ink flows in the descender 29 and flows into the nozzle 21. Here, in a case that the discharge pressure is applied by the actuator 60 to the pressure chamber 28, the ink is discharged from the nozzle hole 21*a*.

Next, a plurality of manifold holes 70 communicating with the supply hole 24, and a partition wall 72 which partitions adjacent manifolds 70, will be explained with reference to FIGS. 3 and 4. Note that although the supply hole 24, the supply manifold 22 and the manifold holes 70 (which will be described later on) are each a liquid channel and a cavity, the cavity is illustrated by an outline in FIGS. 3 and 4 so as to facilitate understanding of these elements.

Figure 3:
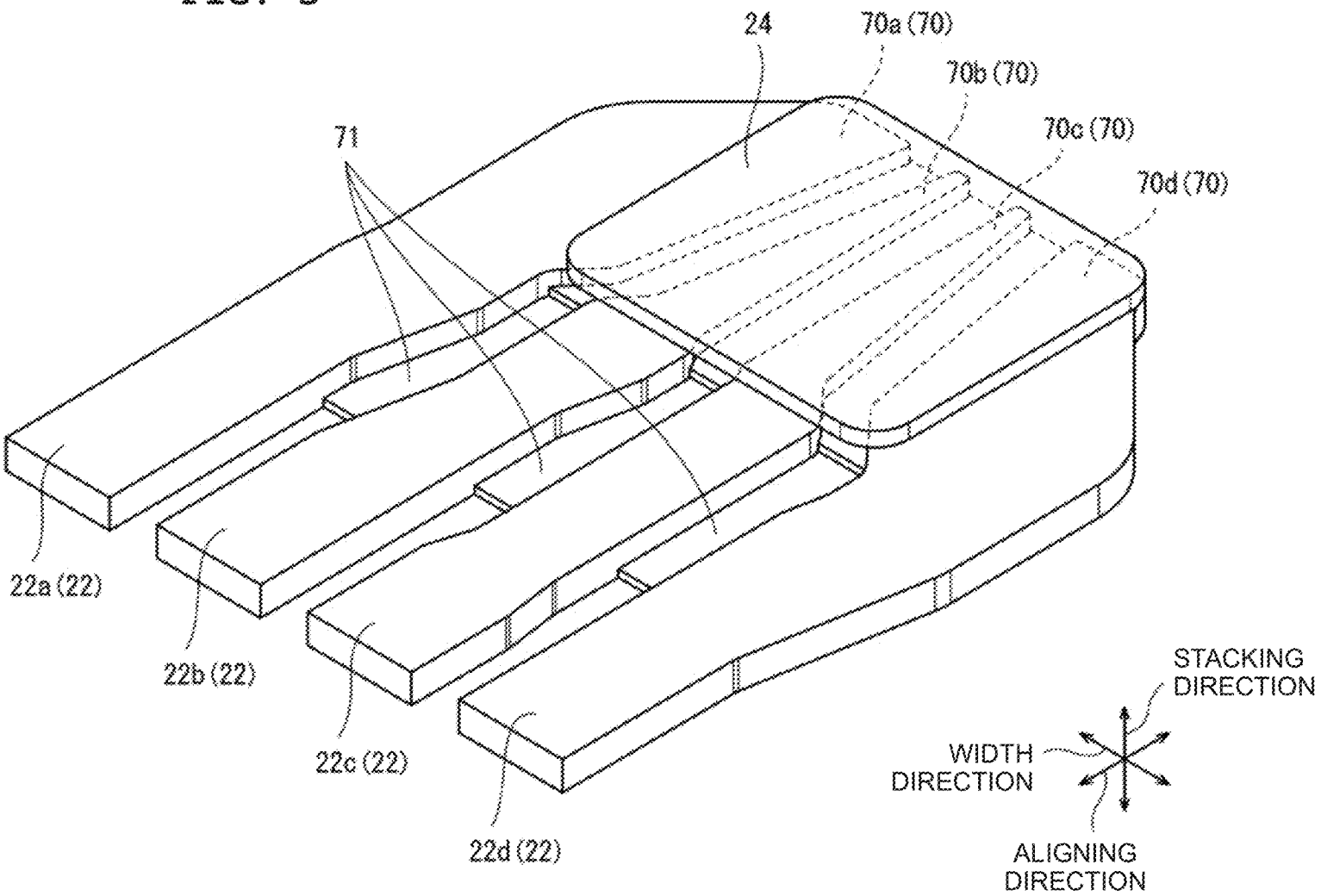
FIG. 3 is a perspective view of a manifold hole and a supply hole.
Figure 4:
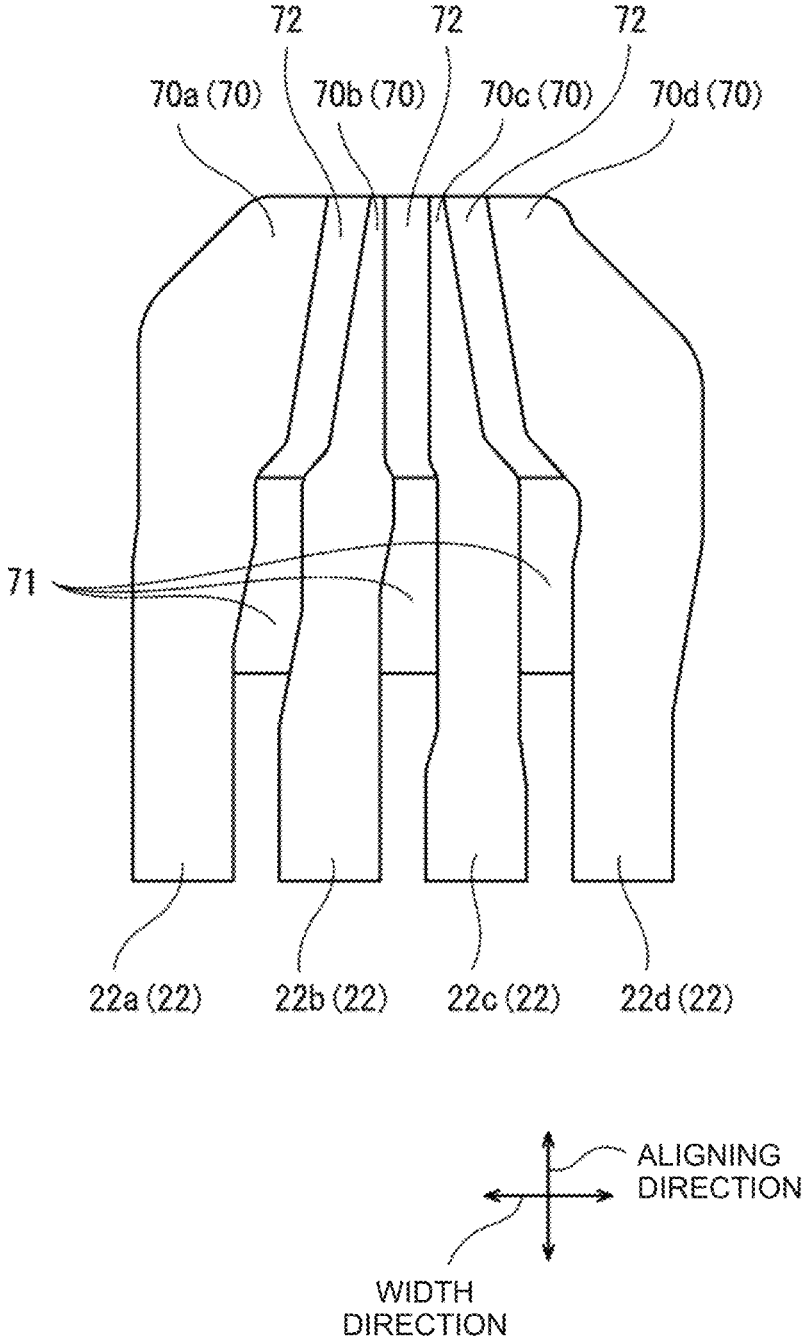
FIG. 4 is a plane view of the manifold hole, the supply hole and a partition wall.

As depicted in FIG. 3, the liquid discharging head 20 has the supply hole 24 to which the liquid is supplied and which has, for example, a square shape in a plane view. The supply hole 24 is connected to the sub tank 18 via a piping. The supply hole 24 is formed, for example, to have a tubular shape, and is arranged at one end in the aligning direction (the extending direction of the supply manifold 22).

Here, a plurality of pieces of the supply manifold 22 are arranged at a location below the supply hole 24. In the present embodiment, for example, four supply manifolds 22*a*, 22*b*, 22*c* and 22*d* extend, as the plurality of supply manifolds 22, in the aligning direction in this order. Among the supply manifolds 22*a*, 22*b*, 22*c* and 22*d*, one and the other of adjacent supply manifolds which are adjacent to each other are partitioned from each other by the partition wall 72. Further, in the present embodiment, a size in the width direction, which is the direction orthogonal to the aligning direction, of the supply hole 24 is smaller than a size from an outer side end of the supply manifold 22*a* which is on one side in the width direction to an outer side end of the supply manifold 22*d* which is on the other side in the width direction. With this, the supply hole 24 is made to be small.

Each of the four supply manifolds 22 has the manifold hole 70 communicating with the supply hole 24. The supply manifolds 22*a*, 22*b*, 22*c* and 22*d* have manifold holes 70*a*, 70*b*, 70*c* and 70*d*, respectively. In the present embodiment, the manifold holes 70*a*, 70*b* 70*c* and 70*d* are each long in the aligning direction. Further, each of the manifold holes 70 extends obliquely with respect to the aligning direction. As depicted in FIG. 4, a part of wall surfaces defining the manifold hole 70*a* extends obliquely with respect to the aligning direction. One wall surface defining the manifold hole 70*b* extends parallel to the aligning direction, whereas another wall surface defining the manifold hole 70*b* extends obliquely with respect to the aligning direction. Further, one wall surface defining the manifold hole 70*c* extends parallel to the aligning direction, whereas another wall surface defining the manifold hole 70*c* extends obliquely with respect to the aligning direction. Furthermore, a part of wall surfaces defining the manifold hole 70*d* extend obliquely with respect to the aligning direction. In such a configuration, a partition wall 72 partitioning the manifold hole 70*a* and the manifold hole 72*b* extends obliquely with respect to the aligning direction; a partition wall 72 partitioning the manifold hole 70*b* and the manifold hole 72*c* extends parallel to the aligning direction; and a partition wall 72 partitioning the manifold hole 70*c* and the manifold hole 72*d* extend obliquely with respect to the aligning direction. Further, in the present embodiment, the widths of the manifold holes 70*a*, 70*b*, 70*c* and 70*d* are gradually widen (widen in a stepped manner) in the aligning direction.

The manifold holes 70*a*, 70*b*, 70*c* and 70*d* are arranged at a location below the supply hole 24. Each of the manifold holes 70*a*, 70*b*, 70*c* and 70*d* is communicated with the supply hole 24. With this, each of the supply manifolds 22*a*, 22*b*, 22*c* and 22*d* is communicated with the supply hole 24.

Each of the supply manifolds 22*a*, 22*b*, 22*c* and 22*d* is communicated with a common space 71 defined at a location below the respective partition walls 72. More specifically, the manifold holes 70*a*, 70*b*, 70*c* and 70*d* are communicated with one another in the common space 71. The width (length in the width direction) of the common space 71 may be not more than the size from the outer side end of the supply manifold 22*a* which is on one side in the width direction to the outer side end of the supply manifold 22*d* which is on the other side in the width direction, among the four supply manifolds 22.

In such a configuration, one manifold hole 70 is arranged so that another manifold hole 70 is not located on an extension line, of the one manifold hole 70, in the aligning direction. Namely, to provide an explanation regarding the example depicted in FIG. 4, the manifold hole 70*a* is arranged so that the manifold holes 70*b*, 70*c* and 70*d* are not located on the extension line, of the manifold hole 70*a*, in the aligning direction. This is similarly applicable also to the other three manifold holes 70*b*, 70*c* and 70*d*, as regarding the manifold hole 70*a*.

The density of the liquid which is used in the liquid discharging head 20 having the above-described configuration is preferably in a range of 1000 kg/m$^3$ to 2000 kg/m$^3$. Further, the viscosity of the liquid is preferably in a range of 3 mPa·s to 8 mPa·s. Furthermore, the surface tension of the liquid is preferably in a range of 20 mN/m to 40 mN/m. Moreover, a supply negative pressure, which is a pressure applied to the side of the nozzle in a case of introducing the liquid to the liquid discharging head 20, is preferably in a range of 70 kPa to 90 kPa.

Here, an analysis was performed regarding a flow of the liquid from the supply hole 24 to the manifold holes 70 in the liquid discharging head 20 of the present embodiment. With reference to FIGS. 5A to 6B, an explanation will be given about the result of analysis, together with a result of analysis of a comparative example. Note that in the comparative example, two supply manifold which are at the outer side among the four supply manifolds communicating with the supply hole have a shape which draws an arc, rather than extending in one direction. Further, in the result of analysis, a flow of air (pressure) was indicated, instead of the flow of the liquid.

Figure 5A:
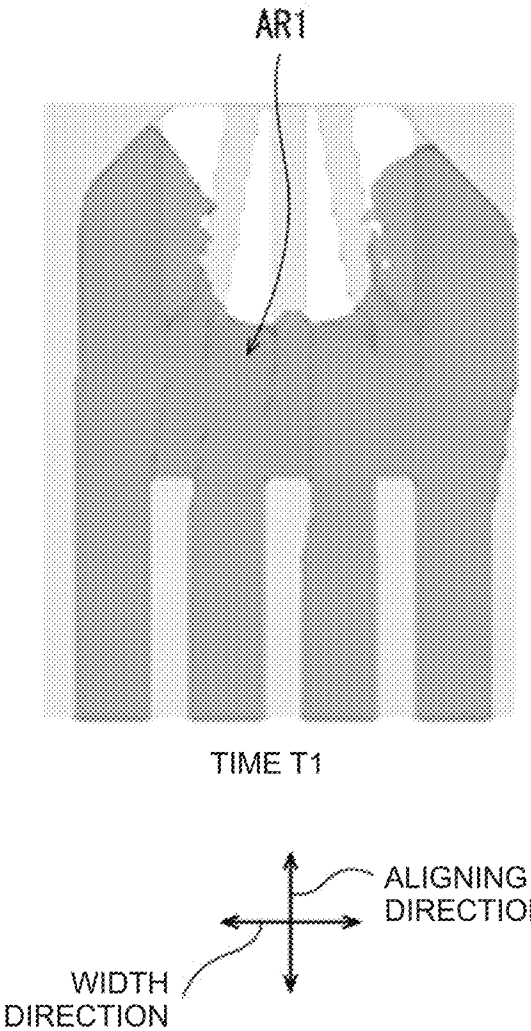
FIG. 5A is a view of a result of analysis indicating the distribution of air at a time T1 in a manifold hole.
Figure 5B:
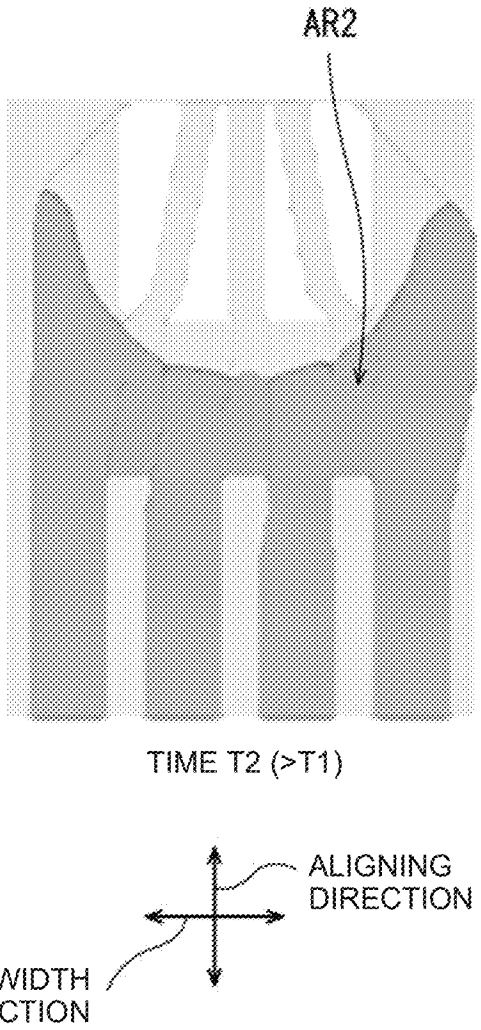
FIG. 5B is a view of a result of analysis indicating the distribution of air at a time T2 in the manifold hole.

As depicted in FIG. 5A, in the liquid discharging head 20 of the present embodiment, it is confirmed that an air area AR1 flowed substantially uniform in the manifold holes 70*a*, 70*b*, 70*c* and 70*d* at the time T1, and that any air bubble was not present, as well. Further, as depicted in FIG. 5B, it is confirmed that, also at the time T2 (>T1), an air area AR2 flowed substantially uniform in the manifold holes 70*a*, 70*b*, 70*c* and 70*d* as the time elapsed, and that any air bubble was not present, as well.

Figure 6A:
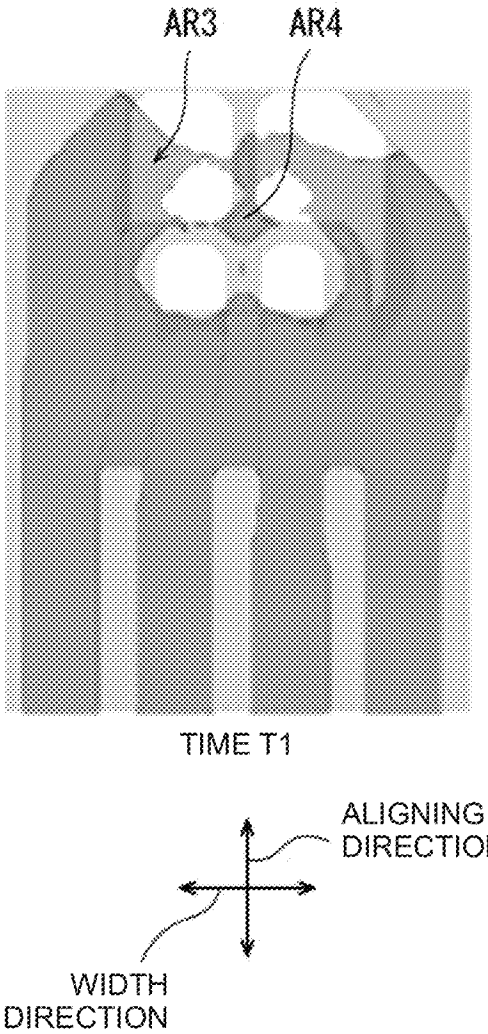
FIG. 6A is a view of a result of analysis indicating the distribution of air at a time T1 in a manifold hole of a comparative example.
Figure 6B:
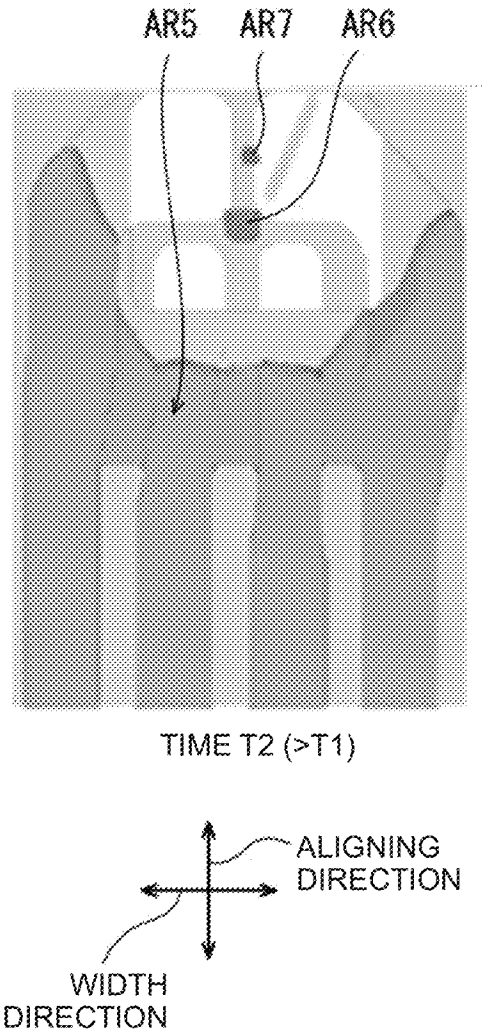
FIG. 6B is a view of a result of analysis indicating the distribution of air at a time T2 in the manifold hole of the comparative example.

In contrast, in the comparative example, as depicted in FIG. 6A, it is confirmed that an air area AR4 indicating air bubbles was present within an air area AR3, at the time T1. Further, as depicted in FIG. 6B, it is confirmed that, also at the time T2, air areas AR6 and AR7 indicating air bubbles were present in the vicinity of an air area AR5. From the above-described results, it is appreciated that in the configuration of the comparative example, there was an area in which the air flow is hard to flow in any direction, as indicated by the air areas AR4, AR6 and AR7, and that thus a stagnation of the liquid occurs.

As explained above, according to the liquid discharging head 20 of the present embodiment, one manifold hole 70 is arranged so that another manifold hole 70 is not located on the extension line of the one manifold hole 70, in the extending direction. Accordingly, any stagnation of the liquid supplied from the supply hole 24 hardly occurs. With this, it is possible to prevent such a situation that any remaining air due to the stagnation absorbs the change in the pressure and that the liquid is not thereby allowed to flow, in the desired flow amount, toward the downstream side of each of the supply manifolds 22. Further, it is also possible to prevent such a situation that the air might flow to the downstream side of the supply manifolds 22, and thus the nozzle(s) 21 might be clogged by the air, and to prevent any non-discharge (omission of discharge) from occurring.

Further, in the present embodiment, the manifold hole 70 is provided as the four manifold holes 70. In view of this point, it is difficult, in view of the design, to provide the manifold holes 70 of which number exceeds 4 (four). By making the number of the manifold hole 70 to be 4 (four), it is possible to secure easiness in the manufacture or production.

Further, in e present embodiment, the manifold hole 70 is long in the extending direction. With this, the stagnation is harder to occur.

Furthermore, in the present embodiment, the size in the width direction of the supply hole 24 is smaller than the size from the outer side end of the supply manifold 22*a* which is on one side in the width direction to the outer side end of the supply manifold 22*d* which is on the other side in the width direction. By making the supply hole 24 to be as small as possible in such a manner, it is possible to secure a spacing distance between adjacent supply holes 24 to be not less than a predetermined value. As a result, it is possible to maintain, more easily, the planeness or flatness of the plate in which the supply holes 24 are formed, in a case of forming the supply holes 24 in the plate by the punching. Moreover, it is also possible to avoid any increase in the cost which would be otherwise brought about any increase in the size of the supply hole 24.

Further, in the present embodiment, a part of the wall surfaces defining each of the manifold holes 70 extends obliquely with respect to the aligning direction. With this, the liquid is allowed to spread in the width direction and to flow more easily into the common space, as compared with an aspect in which the manifold holes 70 extend parallel to the aligning direction. With this, it is possible to discharge (exhaust) the air more easily.

Furthermore, in the present embodiment, the width of each of the manifold holes 70 is gradually widen in the aligning direction. By making the size of each of the manifold holes 70 to be different in the aligning direction, there are provided a part at which the flow is fast and a part at which the flow is slow, thereby making it possible to easily generate the flow toward the common space 71.

Moreover, in the present embodiment, the density of the liquid is preferably in the range of 1000 kg/m$^3$ to 2000 kg/m$^3$. The viscosity of the liquid is preferably in the range of 3 mPa·s to 8 mPa·s. The surface tension of the liquid is preferably in the range of 20 mN/m to 40 mN/m. These lead to a stable discharge of the ink. Specifically, the precision of discharge is improved, and any non-discharge, any bending in discharge and any insufficient discharge amount are harder to occur.

Further, in the present embodiment, the supply negative pressure of the liquid is preferably in the range of 70 KPa to 90 KPa. There is such a problem that in a case that the supply negative pressure, which is the pressure applied to the side of the nozzles 21 when introducing the liquid to the liquid discharging head 20, is too high, any air remains; and that in a case that the supply negative pressure is too low, the supply of the liquid becomes slow. By making the supply negative pressure to be within the above-described range, it is possible to make the above-described problem to hard to occur.

Second Embodiment

Figure 7:
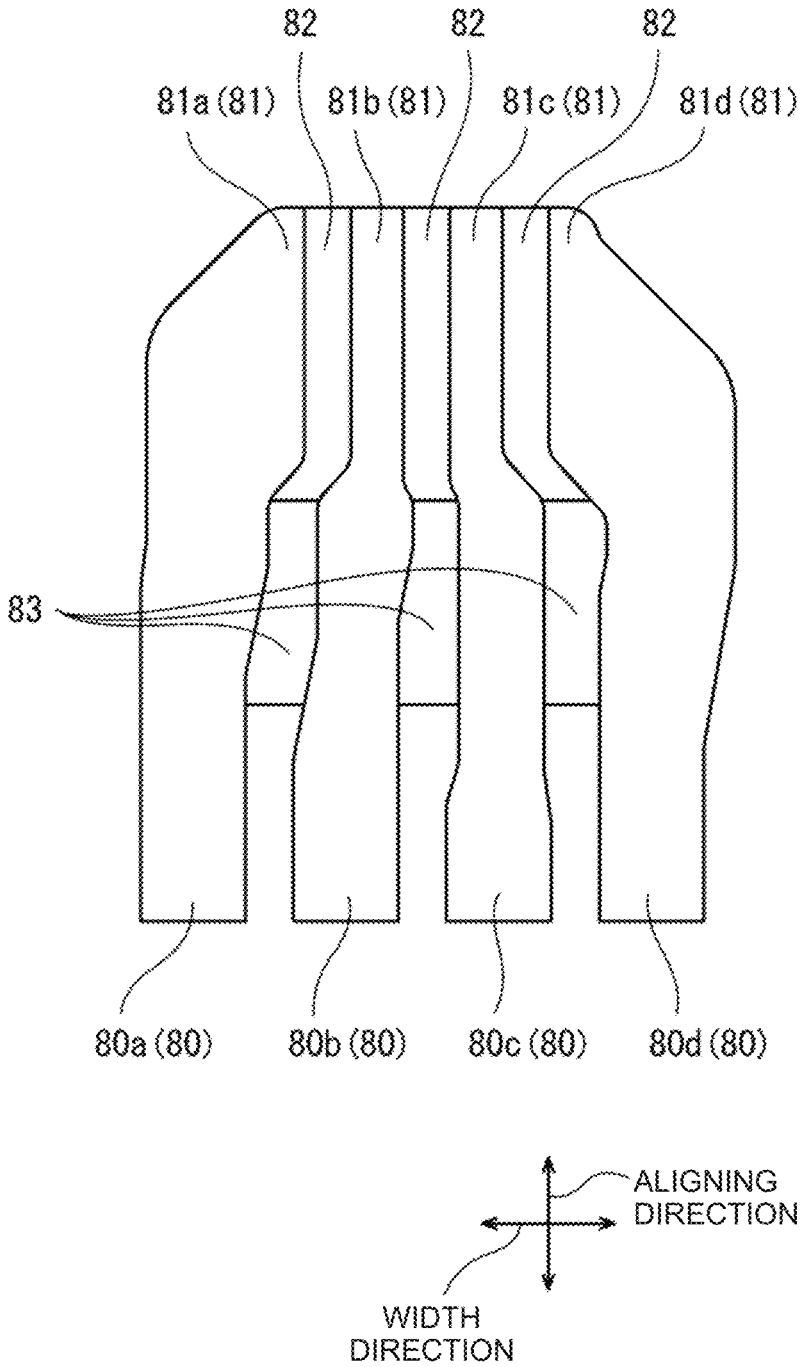
FIG. 7 is a plane view of a manifold hole and a partition wall.

An explanation will be given about a manifold hole 81 and a partition wall 82, etc., according to a second embodiment, with reference to FIG. 7. In FIG. 7, a part of wall surfaces defining a manifold hole 81*a* extends parallel with respect to the aligning direction. A pair of wall surfaces which define the manifold hole 81*b* and which face (are opposite to) each other in the width direction extend parallel to the aligning direction. Further, a pair of wall surfaces defining the manifold hole 81*c* and which face each other in the width direction extend parallel to the aligning direction. Furthermore, a part of wall surfaces defining a manifold hole 81*d* extends parallel with respect to the aligning direction. In such a configuration, in the second embodiment, a partition wall 82 partitioning the manifold hole 81*a* and the manifold hole 81*b* extends parallel with respect to the aligning direction. A partition wall 82 partitioning the manifold hole 81*b* and the manifold hole 81*c* extends parallel to the aligning direction. A partition wall 82 partitioning the manifold hole 81*c* and the manifold hole 81*d* extend parallel with respect to the aligning direction. Note that a reference numeral "83" is a common space.

Similarly to the first embodiment, an analysis was performed regarding a flow of the liquid from the supply hole 24 to the manifold holes 81 in the liquid discharging head 20 of the second embodiment.

Figure 8A:
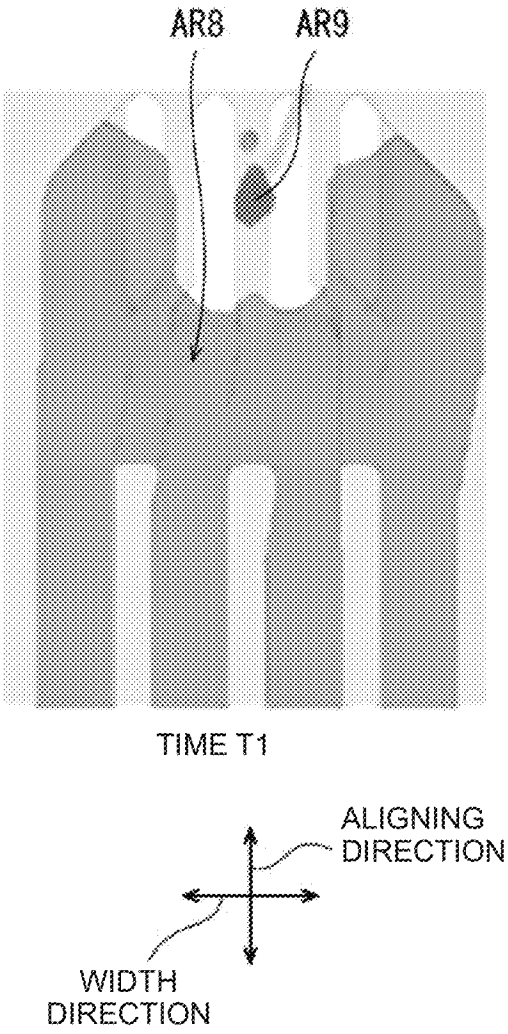
FIG. 8A is a view of a result of analysis indicating the distribution of air at a time T1 in a manifold hole.
Figure 8B:
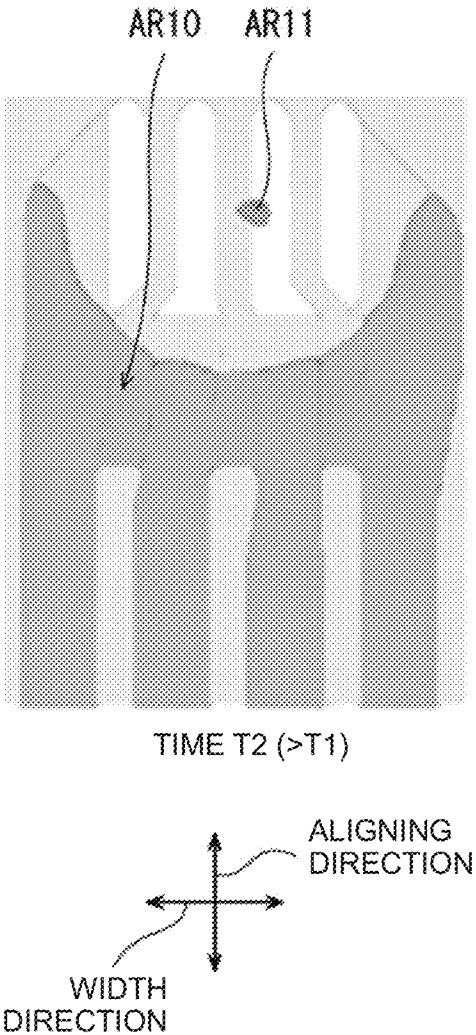
FIG. 8B is a view of a result of analysis indicating the distribution of air at a time T2 in the manifold hole.

As depicted in FIG. 8A, in the liquid discharging head 20 of the second embodiment, it is confirmed that an air area AR8 flowed substantially uniform in the manifold holes 81*a*, 81*b*, 81*c* and 81*d* at the time T1. On the other hand, it is confirmed that an air area AR9 indicating an air bubble was present. Further, as depicted in FIG. 8B, it is confirmed that, also at the time T2 (>T1), although it is confirmed that an air area AR10 flowed substantially uniform in the manifold holes 81*a*, 81*b*, 81*c* and 81*d* as the time elapsed, an air area AR11 indicating an air bubble was still present. Note that after the state of FIG. 8B (namely, T3>T2), it is confirmed that the air area AR11 vanished, and that air bubble(s) in the common space could be removed. From these as described above, from the viewpoint of making the generation of air bubble to be harder, it is appreciated that the first embodiment is more preferred.

Modification

The present disclosure is not limited to or restricted by the above-described embodiments; a variety of kinds of modification is possible within a range not departing from the gist of the present disclosure. The modification is, for example, exemplified as follows.

Figure 9:
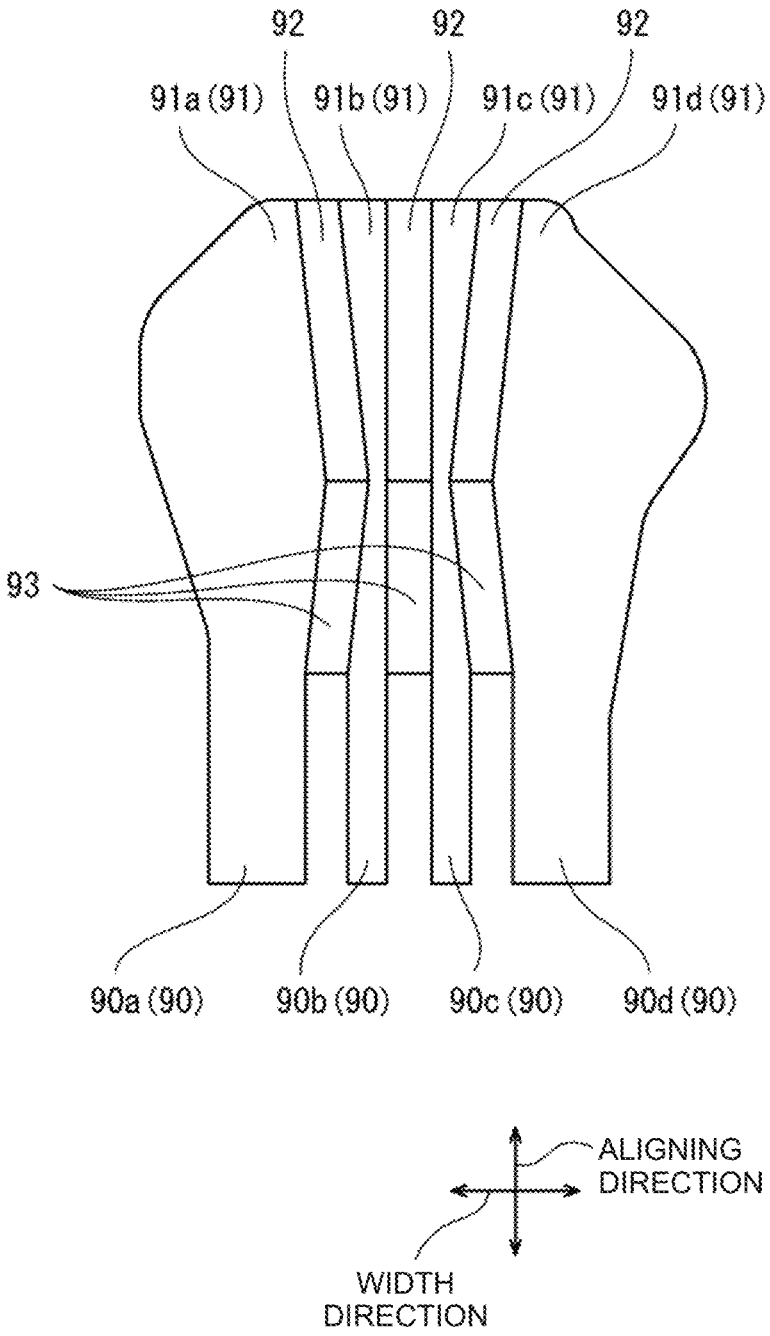
FIG. 9 is a plane view of a modification of the manifold hole.

In the above-described embodiments, the width of each of the manifold holes 70*a*, 70*b*, 70*c* and 70*d* is gradually widen in the aligning direction. The present disclosure, however, is not limited to this. As depicted in FIG. 9, it is allowable that a width of a manifold hole 91 (91*a*, 91*b*, 91*c* 91*d*) of each of supply manifolds 90 (90*a*, 90*b*, 90*c*, 90*d*) may be gradually narrowed in the aligning direction. By making the size of each of the manifold holes 91 to be different in the aligning direction, there are provided a part at which the flow is fast and a part at which the flow is slow, thereby making it possible to easily generate the flow toward the common space. Note that a reference numeral "91" is a partition wall partitioning adjacent manifold holes 91 among the manifold holes 91, and a reference numeral "93" is the common space.

Further, in the above-described embodiments, the width of the common space 71 is made to be not more than the size from the outer side end of the supply manifold 22*a* which is on one side in the width direction to the outer side end of the supply manifold 22*d* which is on the other side in the width direction, among the four supply manifolds 22. The present disclosure, however, is not limited to this. It is allowable that the common space 71 has a width which exceeds the size from the outer side end of the supply manifold 22*a* which is on one side in the width direction to the outer side end of the supply manifold 22*d* which is on the other side in the width direction.

Furthermore, in the above-described embodiments, the supply hole 24 is made to have the square shape. The present disclosure, however, is not limited to this. It is allowable that the supply hole 24 is formed to have, for example, a circular shape.

What is claimed is:

1. A liquid discharging head comprising:

a supply hole to which liquid is supplied from outside thereof;

a plurality of supply manifolds arranged below the supply hole, extending in an extending direction respectively, and configured to communicate with the supply hole; and at least one partition wall configured to partition the supply manifolds from each other, wherein each of the supply manifolds has a manifold hole below the supply hole, the supply manifolds communicate with each other in a common space below the at least one partition wall, and the manifold hole of one supply manifold is arranged so that another manifold hole of another supply manifold is not located on an extension line, of the manifold hole, along the extending direction.

2. The liquid discharging head according to claim 1, wherein a number of the supply manifolds is four, and each of the four supply manifolds has the manifold hole.

3. The liquid discharging head according to claim 1, wherein the manifold hole is long in the extending direction.

4. The liquid discharging head according to claim 1, wherein the supply manifolds are arranged in a width direction which intersects with the extending direction, the supply manifolds include a first supply manifold arranged at an end on one side in the width direction and a second supply manifold arranged at an end on the other side in the width direction, the first supply manifold has an outer end on the one side in the width direction and the second supply manifold has an outer end on the other side in the width direction, and with respect to the width direction, a size of the supply hole is smaller than a size from the outer end of the first supply manifold to the outer end of the second supply manifold.

5. The liquid discharging head according to claim 1, wherein the manifold hole extends obliquely with respect to the extending direction.

6. The liquid discharging head according to claim 1, wherein a width of the manifold hole gradually decreases along the extending direction.

7. The liquid discharging head according to claim 1, wherein a width of the manifold hole gradually increases along the extending direction.

8. The liquid discharging head according to claim 1, wherein density of the liquid is in a range of 1000 $kg/m^3$ to 2000 $kg/m^3$.

9. The liquid discharging head according to claim 1, wherein viscosity of the liquid is in a range of 3 mPa·s to 8 mPa·s.

10. The liquid discharging head according to claim 1, wherein surface tension of the liquid is in a range of 20 mN/m to 40 mN/m.

11. The liquid discharging head according to claim 1, wherein a supply negative pressure of the liquid is in a range of 70 kPa to 90 kPa.

* * * * *